United States Patent [19]

Stormon

[11] 4,087,010

[45] May 2, 1978

[54] APPARATUS FOR MOUNTING A HAND-HELD PAVING BREAKER ON BACKHOE ATTACHMENTS

[76] Inventor: Harry J. Stormon, 908 Camino Real, Sparks, Nev. 89431

[21] Appl. No.: 763,858

[22] Filed: Jan. 31, 1977

[51] Int. Cl.[2] ..... B25D 17/28

[52] U.S. Cl. ..... 214/145 R; 37/117.5; 173/18; 299/67

[58] Field of Search ..... 214/138 R, 145 R, 145 A, 214/620; 37/117.5, DIG. 12, DIG. 18; 299/67; 173/18, 46

[56] References Cited

U.S. PATENT DOCUMENTS

| | | | |
|---|---|---|---|
| 3,497,017 | 2/1970 | Goettl et al. | 173/18 |
| 3,584,816 | 6/1971 | Salkeld | 248/16 |
| 3,595,411 | 7/1971 | Ables | 214/145 R |
| 3,596,996 | 8/1971 | Carter | 37/117.5 X |
| 3,627,064 | 12/1971 | Sjoberg et al. | 173/46 X |
| 3,757,875 | 9/1973 | Gunning | 173/44 |

*Primary Examiner*—L. J. Paperner

*Attorney, Agent, or Firm*—James R. Cypher

[57] ABSTRACT

An apparatus for removably mounting a hand-held tool such as a pavement breaker or tamper releasably on the wrist linkage of the bucket for a backhoe attachment for a tractor or truck including an attachment member having a slide rail, a carriage slidably mounted on the slide rail, a biasing member mounted on the attachment member biasing the carriage to a tool nonoperating position and a control member mounted on the attachment member adapted for engaging the tool operating lever.

7 Claims, 7 Drawing Figures

APPARATUS FOR MOUNTING A HAND-HELD PAVING BREAKER ON BACKHOE ATTACHMENTS

BACKGROUND OF THE INVENTION

Innumerable demolition tasks which can be accomplished with a pneumatic or hydraulic actuated hand-held paving breaker are of a magnitude, or have characteristics, such as vertical walls or surfaces, which tax the strength and endurance of the operator. Usually, the paving breaker or tool, the working steels, and the fluid hose and fittings, make an approximate one-hundred pound load for the operator to carry and manipulate. Generally, this weight precludes the extended use of the tool on anything other than in a downward direction on an essentially horizontal surface.

Axiomatically, demolition implies that the material broken will be removed or loaded and utilized in most construction and mining operations. Often this is accomplished by utilizing the widely used tractor/-loader/backhoe, or truck mounted backhoe equipment, that would normally be standing idle while the material was being broken by a man using a hand-held breaker. It is the purpose of this invention to provide a practical device that will permit the mounting of the normally hand-held paving breaker onto the bucket or the dipper stick and bucket wrist linkage of the backhoe attachment. Previous attempts at mounting a light weight impactor on a backhoe attachment such as Saikelo U.S. Pat. No. 3,584,816 and Gunning U.S. Pat. No. 3,757,875 have proven to be less than satisfactory for several reasons. First, they required modification of the tool in such a fashion, that it precluded the use of the tool in its conventional hand-held mode. Second, the tools were mounted in a rigid manner, thus, they telegraphed the shock and vibration of the tool through the backhoe components. Third, and finally, the manner in which the tools were mounted, failed to make any provision for the prevention of damage to the tool if misoperation caused the backhoe boom, tool mount, and tool, to be accidentally dropped on to the hard surface being worked on or the force exerted by the backhoe mechanism exceeded the strength of the tool.

SUMMARY OF THE INVENTION

As shown in this invention, these necessary safety features are included in a practical device which incorporates an automatic start/stop provision utilizing the fluid control valve built into the handle of the tool itself. This invention also reduces or eliminates the transmission of shock and vibration from the operating tool to the backhoe components, by the inclusion of a shock adsorbing device within the tool mount. Uniquely, the breaker tool can be quickly detached from the mount and used manually for any portion of the task where access is so limited that it precludes the use of the tool in its mounted mechanized mode of operation.

The primary object of the invention is to mate widely used and relatively inexpensive, but exhausting to operate, paving breakers; with hydraulic power actuated backhoe attachments which are often available at the same job-site, so that the breakers can be manipulated by mechanical power instead of man power.

Another objective is to provide the above utility without alteration to the paving breaker so that it can be easily and quickly removed from its carrier mechanism and used manually if required.

Still another objective is to provide the above, with safety to the operator and protection for the equipment being utilized.

The object of this invention is to provide a practical attachment device which can be readily installed on the bucket or bucket linkage of essentially any tractor or truck mounted backhoe attachment, thus permitting the mechanized utilization of an unaltered normally hand-held, paving breaker or paving breaker used as a tamper. It is a further object to absorb the inherent shocks generated by the tool while in use. Other features includes; an automatic start/stop control mechanism, safety provisions to prevent damage to the mounted tool, and finally, a feature which allows for the quick detachment of the breaker so that it may be used, when required, in its normal manual mode of operation.

DESCRIPTION OF THE PREFERRED EMBODIMENTS OF THE INVENTION

Figure 1:
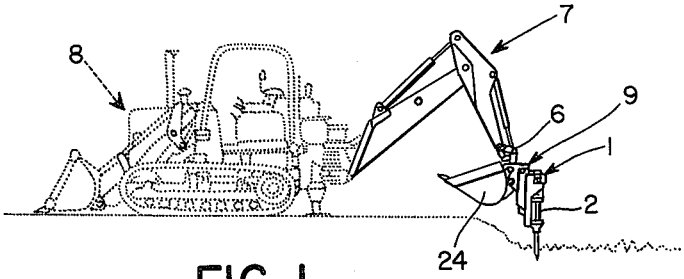
FIG. 1 is a side elevation view of a tractor fitted with a backhoe attachment including bucket and the attachment of the present invention holding a pavement breaker in a position for breaking a horizontal surface.

The apparatus 1 for mounting a hand-held tool such as a paving breaker 2 or tamper 3 having an operating lever 4 on the end 6 of a backhoe attachment 7 for a truck or tractor 8 consists of an attachment means 9 removably affixed to the end 6 of the backhoe and is formed with a slide rail 11. The carriage member 12 is slidably mounted on the attachment means for movement between a first non-operative position of the tool to a second operative position including a handle holding member 13 and 13' adapted for removably holding the the handle portion 14 of the tool. A biasing means such as a spring 16 is attached to the attachment means at a fixed end 17 as by a pin 18 and is attached to the carriage member at its movable end 19 by pin 21 for biasing the carriage toward the first non-operative position of the tool. A control lever 22 is mounted on the attachment means on pin 18 and is adapted for engagement with the tool operating lever 4 in the second operative position of the carriage.

Figure 2:
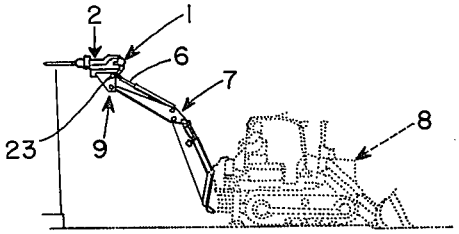
FIG. 2 is a side elevation view of the payment breaker of FIG. 1 positioned for breaking a vertical wall surface above the tractor and well above the reach of an individual operator. The backhoe bucket is removed.
Figure 3:
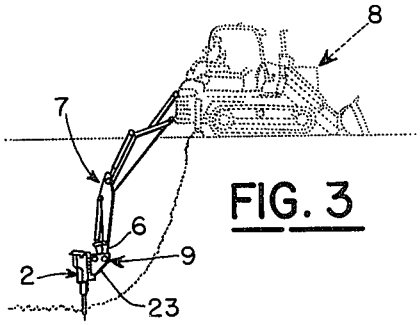
FIG. 3 is a side elevation view of the pavement breaker of FIG. 2 positioned for breaking a horizontal surface several feet below the level of the tractor.
Figure 4:
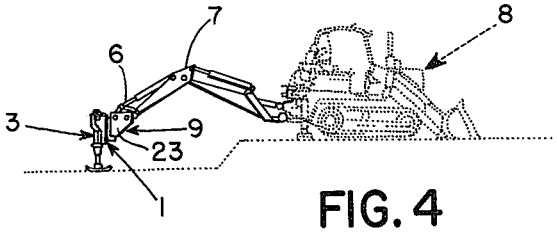
FIG. 4 is a side elevation view of an alternate hand held tool such as a compactor connected to the backhoe attachment of a tractor.

The apparatus may be attached to a transition member 23 as shown in FIGS. 2, 3 and 4 or to the bucket 24 mounted on the backhoe attachment. As shown in FIGS. 1, 5, 6 and 7, the backhoe attachment has an overlength pin 26 mounted on the backhoe bucket. A hook-shaped member 27 is formed in the attachment means and is adapted for attachment to the overlength pin.

A removable pin 28 is dimensioned for registration with openings 31 and 32 in the attachment means and the backhoe bucket for securing the apparatus to the backhoe bucket.

Figure 5:
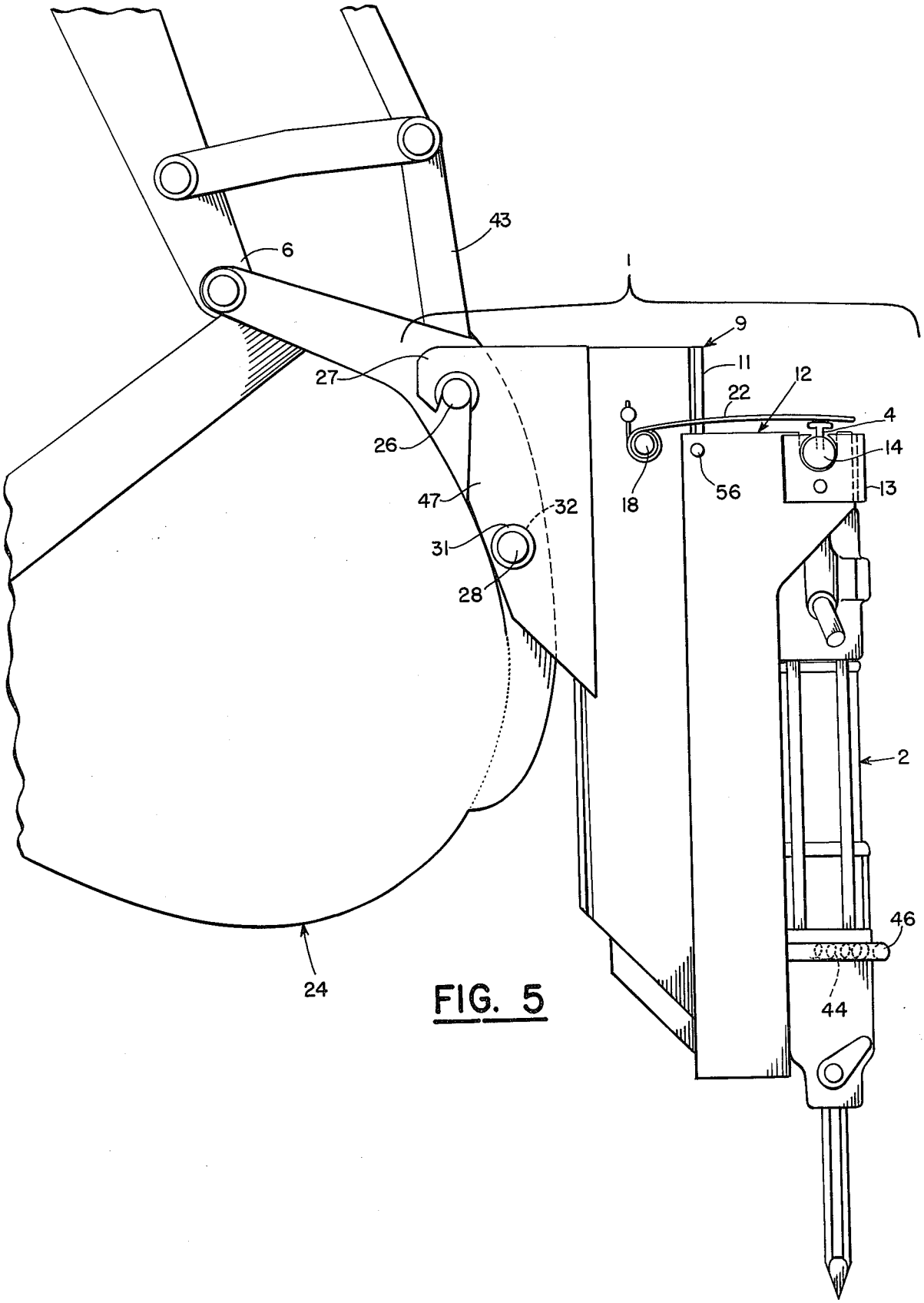
FIG. 5 is an elevation view of the invention installed on a backhoe attachment bucket with a paving breaker installed in operating position.
Figure 6:
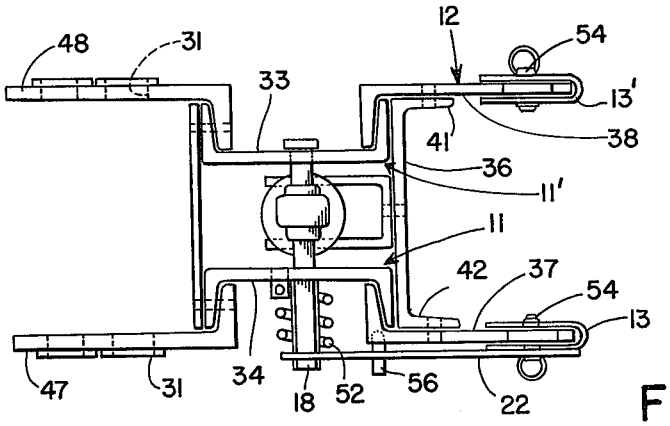
FIG. 6 is a plan view of the mechanism of the invention.
Figure 7:
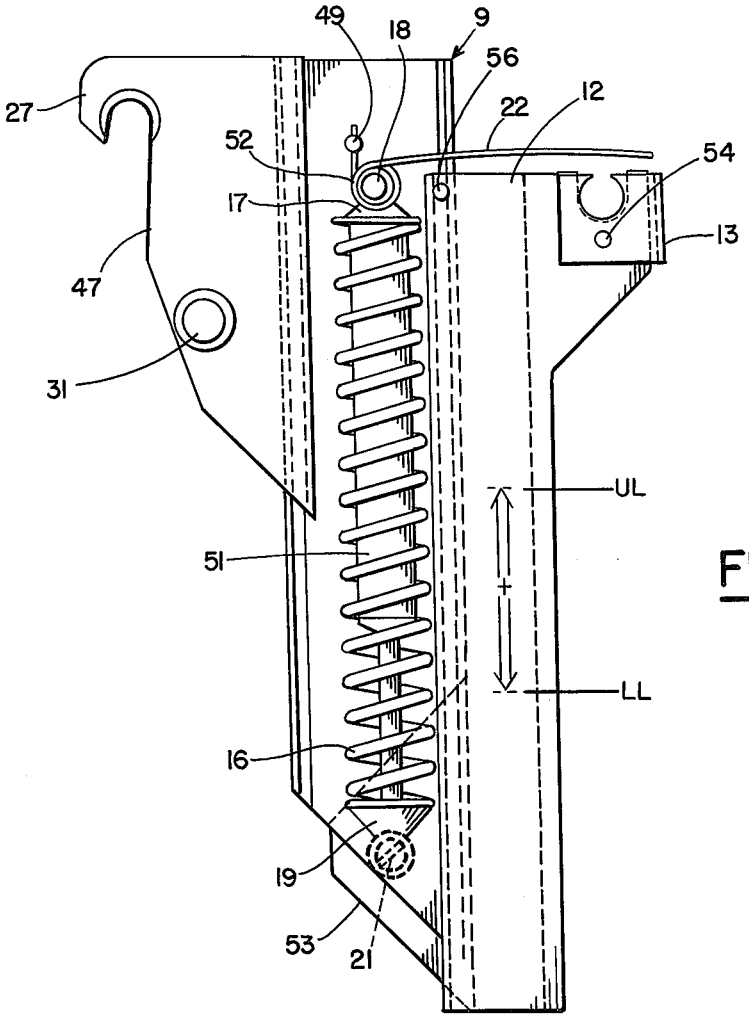
FIG. 7 is an elevation view of the invention with the internal components revealed.

As shown in FIGS. 5, 6 and 7, the attachment means is formed with a pair of parallel rails 11 and 11'. The carriage is formed with a pair of guides for sliding on the rails. The rails of the attachment means may consist of a pair of spaced elongated channel members 33 and 34. The carriage guides may consist of a channel member 36 and a pair of L-shaped members 37 and 38 connected to the flanges 41 and 42 of the channel member.

FIG. 5 illustrates the apparatus of the present invention installed on the over-length pin 26 which connects the backhoe bucket 24 to the wrist linkage 43 carried at the end of the backhoe dipper stick 6. The pneumatic or hydraulic paving breaker 2 is shown suspended in the tool carriage of the invention by its handle 14 with the torsion spring 52 of control lever 22 depressing the fluid on/off valve lever 4 of the paving breaker in an on position. A tension coil spring 44 encased in a suitable section of rubber hose 46 is attached in the lower part of the tool carriage to maintain alignment of the tool.

FIG. 7 illustrates the essential features of the invention that contribute to its utilization in mechanizing the operation of a typical hand-held paving breaker. The attach plates 47 and 48 of the attachment means are provided with a configuration consisting of a hook forming slot 27 which drops over the over-length pin which is a part of the backhoe bucket wrist linkage. The attach plates are then firmly installed with the single pin 28 through the lower holes of these plates and the lower holes (dig position) of the bucket attach frame as shown. Fixed to the plates 47 and 48 are the back to back channels 33 and 34 which are the enclosure for and upper fixed anchor locations 18 and 49 of the compression spring 16 and shock absorber 51 assembly and torsion spring 52 connected to the on/off control 22. The slide mounted tool carriage assembly 12 is attached to the lower mounting bracket 53 which is the movable anchor location of the spring-shockabsorber assembly 16 and 51. When the device has not been lowered so that the breaker steel of the tool 2 in FIG. 5 is thrust against the object to be broken, the slide tool carrier is in the nominal lower level LL position. In this position the control spring lever 22 is not depressing the valve actuating lever 4 and the breaker does not function. As the backhoe operator does lower the device and the breaker is thrust onto the object to be broken, the breaker is pushed upward against the spring pressure resistance through the latches or handle holding members 13 and the safety shear pins 54 pushing the carriage 12 upward and the fixed position spring lever 22 depresses the valve actuating lever 4 causing the breaker to function until the operator lifts the device or the object is broken and the tool and its carrier slide downward and valve lever 4 is released by disengaging from spring rod 22 causing the functioning of the breaker to automatically stop. If, while in functioning position, the operator should over control and apply excess downward trust to the device, the carrier continues to be pushed upward beyond its nominal thrusting position range toward its upper limit of travel, UL as shown in FIG. 7. Toward the UL position, the over-pressure safety limit control pin 56 contacts spring lever 22 and raises it from the breaker valve handle, again causing the breaker to automatically stop functioning, which is also notice to the operator of the over-thrust condition he has caused. As he corrects by raising the device somewhat into the nominal range, the breaker automatically resumes functioning until the device is raised from the work or the object is broken. By these means, the breaker does not function when the breaker is not in contact with the work which would require the device and backhoe attachment to absorb the high-cycle energy rather than it being absorbed in the object to be broken. Further safety protection for the tool and device is provided by the simple latch safety pins 54 shearing if misoperation causes extreme over-thrust or if the entire backhoe boom, device and tool are inadvertently dropped on to a hard surface.

It is also a feature of the design of the invention that essentially any of the widely used paving breakers do not have to be altered in any way and by merely withdrawing the latch safety pins 54, the breaker can immediately be used in its hand-held mode where lack of access may dictate.

I claim:

1. An apparatus for mounting a hand-held tool, such as a paving breaker or tamper having an operating lever, on the end of a backhoe attachment for a truck or tractor comprising:

a. attachment means removably affixed to the end of said backhoe and formed with a slide rail;

b. a carriage member slidably mounted on said attachment means for movement between a first non-operative position of said tool to a second operative position including a handle holding member adapted for removably holding the handle portion of said tool;

c. biasing means attached to said attachment means at a fixed end and attached to said carriage member at its movable end for biasing said carriage toward said first non-operative position of said tool;

d. a control lever mounted on said attachment means adapted for engagement with said tool operating in said second operative position of said carriage; and e. said control lever is spring mounted to prevent damage thereto when said carriage moves beyond said normal operative second position.

2. An apparatus as described in claim 1 comprising:

a. a safety pin mounted on said carriage positioned for engagement with said control lever for movement of said lever out of engagement with said tool operating lever when the force exerted by said backhoe attachment on said carriage member exceeds a preselected force.

3. An apparatus as described in claim 2 comprising:

a. a holdown member slidably mounted on said carriage and adapted for engaging the handles of said tool; and b. a shear pin connected to said carriage and to said holdown member dimensioned to shear and release said tool from said carriage when the force exerted on said tool exceeds a preselected force greater than the force causing said safety pin to lift said control lever from said tool operating lever.

4. An apparatus as described in claim 1 comprising:

a. a shock absorber connecting said carriage and said attachment means.

5. An apparatus as described in claim 1 including a bucket mounted on said backhoe attachment comprising:

a. said backhoe attachment having an overlength pin mounted on said backhoe bucket;

b. a hook-shaped member formed in said attachment means adapted for attachment to said overlength pin; and c. a removable pin dimensioned for registration with openings in said attachment means and said backhoe bucket for securing said apparatus to said backhoe bucket.

6. An apparatus as described in claim 1 comprising:

a. said attachment means is formed with a pair of parallel rails; and b. said carriage is formed with a pair of guides for sliding on said rails.

7. An apparatus as described in claim 6 comprising:

a. said rails of said attachment means consist of a pair of spaced elongated channel members; and b. said carriage guides consist of a channel member and a pair of L-shaped members connected to the flanges of said channel member.

* * * * *